US005585897A

United States Patent [19]

Takeda et al.

[11] Patent Number: 5,585,897

[45] Date of Patent: Dec. 17, 1996

[54] CONTACT CHARGING DEVICE FOR CHARGING A SURFACE TO A GIVEN POTENTIAL AND IMAGE FORMING APPARATUS USING THE SAME

[75] Inventors: Kazuhisa Takeda; Hiromichi Mitamura, both of Tagata-gun, Japan

[73] Assignee: Kabushiki Kaisha TEC, Shizuoka, Japan

[21] Appl. No.: 409,727

[22] Filed: Mar. 24, 1995

[30] Foreign Application Priority Data

Mar. 25, 1994 [JP] Japan ..... 6-055890

[51] Int. Cl.[6] ..... G03G 15/00

[52] U.S. Cl. ..... 355/219; 361/221

[58] Field of Search ..... 355/219, 271, 355/222, 274, 277; 361/221, 225, 212, 214, 230; 250/324, 325, 326

[56] References Cited

U.S. PATENT DOCUMENTS

| | | | |
|---|---|---|---|
| 4,371,252 | 2/1983 | Uchida et al. | 355/219 |
| 5,225,878 | 7/1993 | Asano et al. . | |
| 5,241,342 | 8/1993 | Asano et al. | 355/219 |
| 5,249,022 | 9/1993 | Watanabe et al. | 355/271 |
| 5,289,234 | 2/1994 | Asano et al. | 355/219 |

FOREIGN PATENT DOCUMENTS

| | | |
|---|---|---|
| 0330820 | 9/1989 | European Pat. Off. . |
| 0521451 | 1/1993 | European Pat. Off. . |
| 0617344 | 9/1994 | European Pat. Off. . |

OTHER PUBLICATIONS

Patent Abstracts of Japan, vol. 10, No. 223 (P–483) (2279), Aug. 5, 1986, JP–61–57955, Mar. 25, 1986.

*Primary Examiner*—Thu Anh Dang

*Attorney, Agent, or Firm*—Oblon, Spivak, McClelland, Maier & Neustadt, P.C.

[57] ABSTRACT

Disclosed herein is a contact charging device for uniformly charging a moving subject surface to a given potential by bringing a charging member to which a voltage is applied into contact with the moving subject surface. The charging member has a brush structure formed by closely setting a plurality of conductive bristle members into a conductive base member. The charging member is positioned so that the amount of engagement of the conductive bristle members with the subject surface is large on the upstream side of a surface moving direction of the subject surface and small on the downstream side of the surface moving direction. Accordingly, the adhesion of all the conductive bristle members to the subject surface can be enhanced and the deformation of all the conductive bristle members can be prevented. Further, the springing phenomenon of the conductive bristle members on the upstream side having a high charging efficiency can be eliminated. As a result, the subject surface can be charged uniformly and stably.

13 Claims, 4 Drawing Sheets

CONTACT CHARGING DEVICE FOR CHARGING A SURFACE TO A GIVEN POTENTIAL AND IMAGE FORMING APPARATUS USING THE SAME

BACKGROUND OF THE INVENTION

1. Field of the Invention

The present invention relates to a charging device for uniformly charging a surface (subject surface) of a body to be charged (subject body) used in an electrophotographic apparatus or the like to a given potential, and more particularly to a contact charging device for charging a subject surface in such a condition that a charging member is in contact with the subject surface.

2. Description of the Prior Art

FIG. 4 shows an exemplary printing section 10 forming a part of an electrophotographic apparatus, copying machine, facsimile machine, etc.

Referring to FIG. 4, reference numeral 1 denotes an image supporting body (subject body) formed as a cylindrical body whose outer circumferential surface is coated with a photosensitive material. Provided around the image supporting body 1 are a contact charging device 20, exposure means 2, developing roller 3 constituting a developing unit, transfer unit 4, waste toner blade 5, and erasing unit 6.

The image supporting body 1 which is completely round is adapted to rotate about its center Q in a direction of arrow R at a constant speed. A subject surface 1*a* is formed on the outer circumferential surface of the image supporting body 1. The subject surface 1*a* is uniformly charged to a given potential Vc (e.g., −500 V) when passing a position opposed to the contact charging device 20. Then, the subject surface 1*a* is exposed to light directed from the exposure means 2 to form an exposed portion (electrostatic latent image) charged to a given potential Vim (e.g., −50 V). The electrostatic latent image formed on the subject surface 1*a* is supplied with a toner T from the developing roller 3 to form a toner image as a developed image.

The toner image formed on the subject surface 1*a* is transferred onto a sheet of paper P moving in a direction of arrow X when passing a position opposed to the transfer unit 4. Thereafter, the toner image transferred onto the paper P is moved to a fuser (not shown). On the other hand, the subject surface 1*a* having passed the position opposed to the transfer unit 4 comes to the waste toner blade 5, by which a remaining toner is removed from the subject surface 1*a*. Then, the charge on the subject surface 1*a* is uniformly erased to an initial potential (e.g., −50 V) by the erasing unit 6.

Conventionally, the contact charging device 20 shown in FIG. 4 and a corona discharge type charging device are selectively adopted as a charging device. The corona discharge type charging device has various defects such as an increase in cost due to provision of a very high-voltage power unit, an increase in space due to formation of a shield chamber, the generation of ozone due to corona discharge, and defective charging due to deterioration of a discharging wire. Therefore, the contact charging device is generally adopted in many cases.

The contact charging device 20 shown in FIG. 4 is composed of a charging roller 101 forming a charging member and a very high-voltage power unit 21 for applying a very high voltage (e.g., −5 kV) to the charging roller 101. The charging roller 101 is composed of a round shaft member 29 and a conductive portion 28 attached to the outer circumferential surface of the round shaft member 29. The conductive portion 28 is formed of rubber in which conductive particles are mixed. In general, the charging roller 101 is adapted to rotate as following the rotation of the image supporting body 1.

In operating the printing section 10, the conductive portion 28 of the charging roller 101 is brought into contact with the subject surface 1*a* formed on the outer circumferential surface of the image supporting body 1 which surface 1*a* is moved in the direction R at a constant speed, thereby charging the subject surface 1*a* to a given potential (e.g., −500 V).

The problems of the prior art as mentioned above will now be described. In the contact charging device as shown in FIG. 4, only when all conditions for uniform charging of the subject surface 1*a* are satisfied, the subject surface 1*a* can be uniformly charged. However, because increasing high-quality printing has been strongly demanded in recent years, such all conditions are difficult to satisfy in an actual charging device. Accordingly, it is difficult to uniformly charge the subject surface 1*a*. For instance, if the uniformity of the composition material of the conductive portion 28 is lacking for such a reason that there are variations in distribution of the conductive particles, the subject surface 1*a* cannot be uniformly charged. Also, if the outer diameter of the image supporting body 1 is not uniform in the axial direction of the image supporting body 1, the subject surface 1*a* cannot be uniformly charged.

Furthermore, in the contact charging device 20 as shown in FIG. 4, it is difficult to mount the device 20 so that a contact pressure of the conductive portion 28 against the subject surface 1*a* falls within a given range, and it is also difficult to stably maintain the pressure contact condition of the conductive portion 28 during the operation. If the contact pressure of the conductive portion 28 against the subject surface 1*a* is too small, the nonuniformity of charging occurs because of an increase in uncharged portion of the subject surface 1*a*. Conversely, if the contact pressure is too large, direct charge injection occurs in addition to an original discharging operation, causing an increase in charge on the subject surface 1*a* and simultaneously causing damage to the subject surface 1*a* and the conductive portion 28. As a result, high-quality printing cannot be ensured.

In addition, the charge on the subject surface 1*a* varies with a surface moving speed of the conductive portion 28. If the surface moving speed of the conductive portion 28 is low, the time of contact between the image supporting body 1 and the conductive portion 28 is very long, causing the acceleration of occurrence of the charge injection mentioned above. In this case, the charge potential (Vim) of the subject surface 1*a* is increased to cause the generation of white lines on a printed surface. This is due to the fact that reversal development is performed in such a manner as not to deposit a toner on a high-potential portion of the subject surface 1*a* but to deposit the toner on a low-potential portion of the subject surface 1*a* formed by the exposure means. This high-potential portion on which no toner is deposited causes the generation of white lines on a printed surface. Conversely, if the surface moving speed of the conductive portion 28 is high, a motor capacity needs to be large to cause an increase in power consumption, which is inconvenient from a viewpoint of structure of the device.

SUMMARY OF THE INVENTION

It is accordingly a first object of the present invention to uniformly charge the whole of the subject surface without the nonuniformity of charging.

It is a second object of the present invention to facilitate the setting of the contact pressure of the charging member against the subject surface and facilitate the assembly and adjustment of the device.

It is a third object of the present invention to prevent the damage to the subject surface by the charging member.

Basically, the present invention provides a contact charging device for uniformly charging a subject surface by making contact between a charging member to which a voltage is applied and the subject surface during its surface movement. The charging member is formed to have a brush structure consisting of a conductive base member and a plurality of conductive bristle members closely set in the conductive base member, whereby the problems of the charging roller system can be fully eliminated. The charging member is arranged so that the amount of engagement of the conductive bristle members with the subject surface is large on the upstream side of the surface moving direction of the subject surface and is small on the downstream side of the surface moving direction of the subject surface, whereby the adhesion of all the conductive bristle members to the subject surface can be enhanced and simultaneously the deformation of all the conductive bristle members can be prevented. Accordingly, the springing phenomenon of the conductive bristle members on the upstream side exhibiting a high charging efficiency can be fully eliminated. Consequently, the subject surface can be charged uniformly and stably.

DETAILED DESCRIPTION OF THE PREFERRED EMBODIMENT

Basic Principle of the Invention

Figure 1:
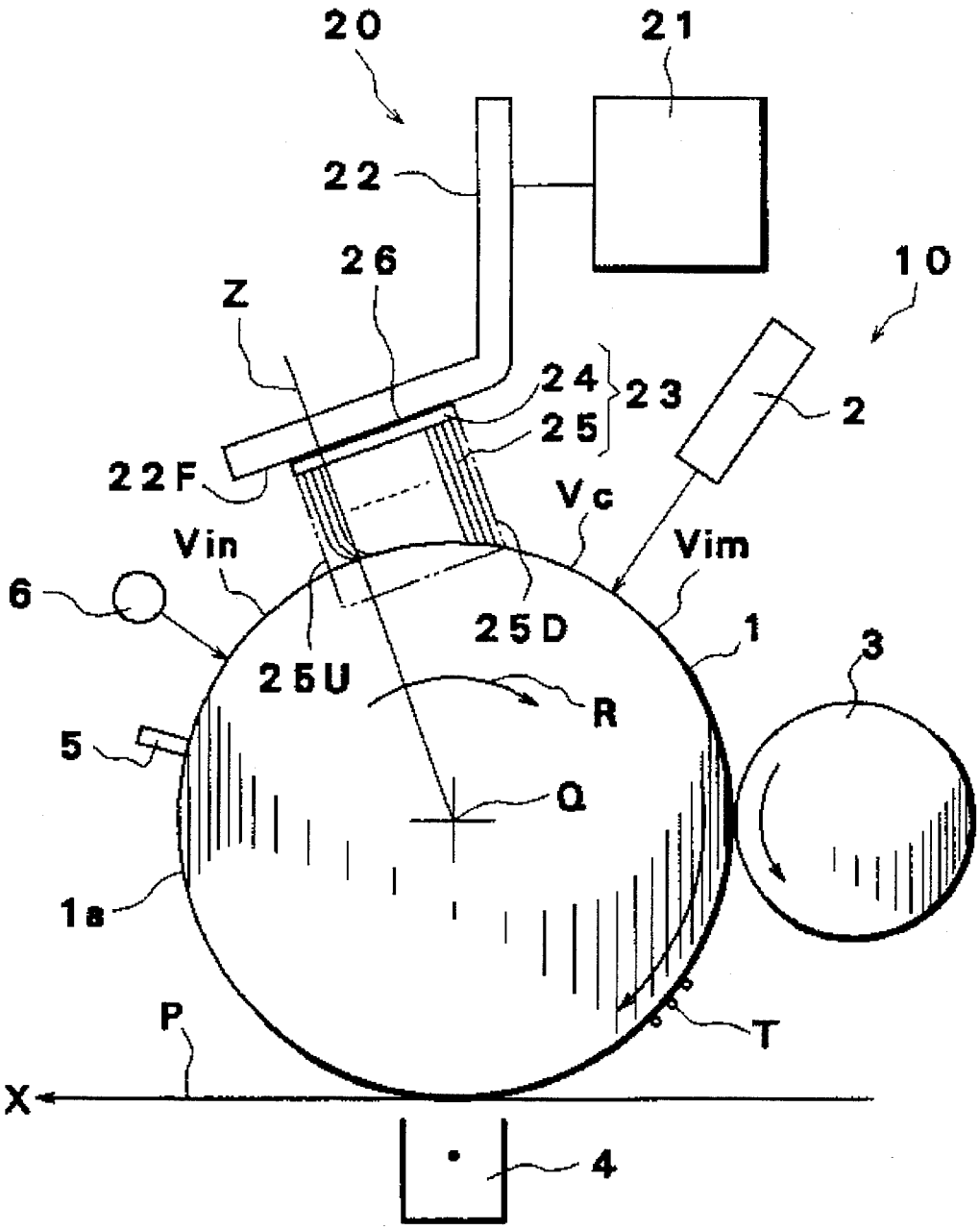
FIG. 1 is an elevational view of a contact charging device and its associated parts according to a preferred embodiment of the present invention.

Prior to description of a preferred embodiment of the present invention, the basic principle of the present invention will be described with reference to FIG. 3. The same or similar structures as those shown in FIG. 4 are denoted by the same reference numerals, and the explanation thereof will be omitted herein. The present invention has been achieved on the basis of the following test results. The test was made to prepare a charging member 23 adopting a brush structure for eliminating the defects of the charging system as shown in FIG. 4 wherein the charging roller 101 formed by mixing conductive particles in rubber is brought into pressure contact with the subject surface 1*a*, that is, eliminating the defects such as the difficulty of high-quality printing due to the nonuniformity of material or form of the charging member, the cost increase, the difficulty of manufacturing and assembly, and the damage to the subject surface 1*a*.

Figure 3:
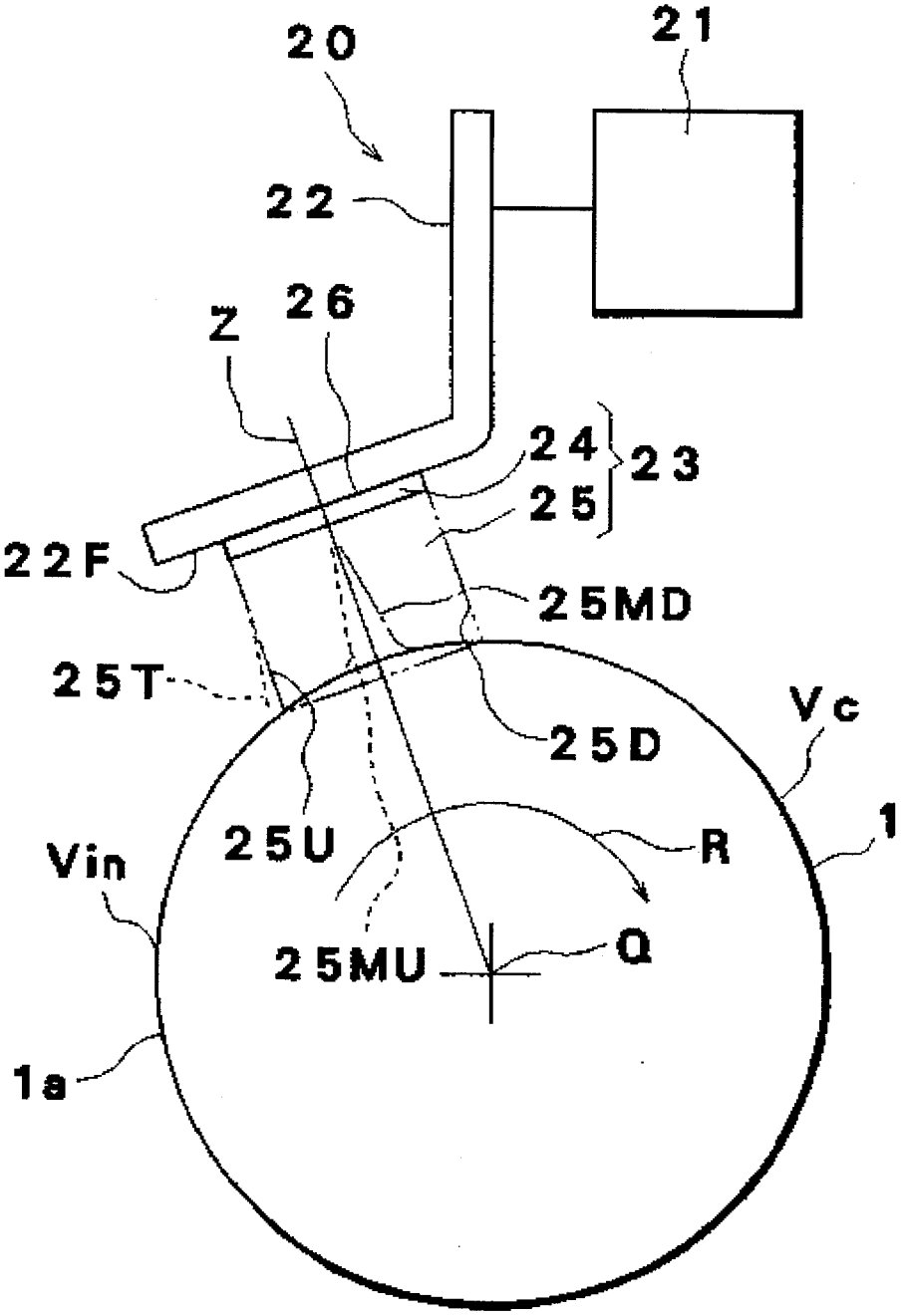
FIG. 3 is an elevational view illustrating the basic principle of the present invention.
Figure 4:
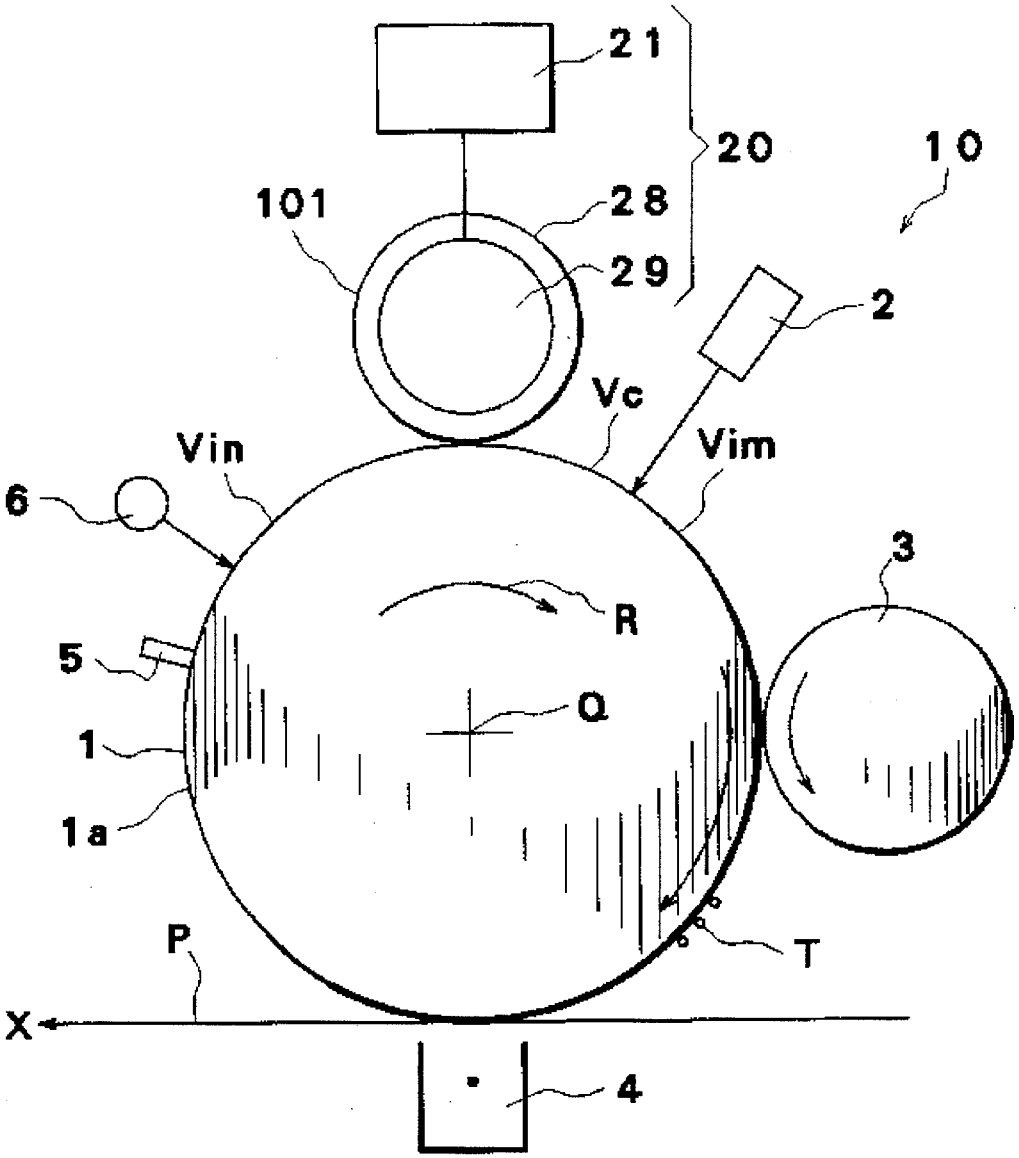
FIG. 4 (PRIOR ART)
FIG. 4 is an elevational view of a contact charging device and its associated parts in the prior art.

As shown in FIG. 3, the charging member 23 having the brush structure was formed by closely setting a plurality of conductive bristle members 25 into a conductive base member 24. The charging member 23 was fixed to a smooth surface 22F of a supporting member 22 by using a double-sided adhesive tape 26. The supporting member 22 was mounted to a body case of the device in such a position as shown in FIG. 3 with respect to a normal line Z selected from the viewpoint of layout of the components of the printing section 10.

The device having such a structure can eliminate the above-mentioned defects of the charging device of the type where the charging roller 101 is brought into pressure contact with the subject surface 1*a*. Furthermore, a contact pressure of the charging member 23 to the subject surface can be easily adjusted only by changing a mounted position of the charging member 23. Accordingly, it was confirmed that charging uniformity can also be greatly improved.

However, it was found that a continuous long-term operation extended near the end of a warranty period required on the market causes the occurrence of charging nonuniformity on the subject surface 1*a*. Such charging nonuniformity on the subject surface 1*a* is considered to be due to the fact that the amount of engagement of the conductive bristle members 25 with the subject surface 1*a* is the largest at a central portion near the normal line Z and becomes smaller toward the upstream side and the downstream side of the normal line Z in the surface moving direction of the subject surface 1*a*.

More specifically, the conductive bristle members 25MD just downstream of the normal line Z at the central portion as shown by a dot-dash line in FIG. 3 and the conductive bristle members 25D further downstream of the conductive bristle members 25MD follow the surface moving direction of the subject surface 1*a*. To the contrary, the conductive bristle members 25MU just upstream of the normal line Z at the central portion as shown by a broken line in FIG. 3 and the conductive bristle members 25U further upstream of the conductive bristle members 25MU resist the surface moving direction of the subject surface 1*a*, causing the susceptibility to deformation. Such deformation of the conductive bristle members 25MU and 25U causes a fluctuation in contact pressure of the charging member 23 against the subject surface 1*a*. Thus, such deformation is considered as a first cause of the charging nonuniformity.

In particular, since the amount of engagement of the conductive bristle members 25U is smaller than that of the conductive bristle members 25MU, the deformation of the former is smaller than that of the latter. However, due to the small deformation, there occurs a springing phenomenon of the conductive bristle members 25T on the most upstream side as shown by a dots-dash line in FIG. 3. The springing phenomenon is such that the conductive bristle members 25 of the charging member 23 bent to the downstream side by the rotation of the image supporting body 1 tends to restore its original position by its own resilience. The conductive bristle members 25T thus showing the springing phenomenon does not contribute to charging of the subject surface 1*a*. It was observed that such a case occurs accidentally or periodically.

In comparing relative potentials of the charging member 23 and the subject surface 1*a*, it is considered that the potentials of all the conductive bristle members 25 are uniform, but the charge potential of the subject surface 1*a* is gradually increased from an initial potential Vin (e.g., −50 V) before charging to reach a final charge potential Vc (e.g., −500 V). That is, it can be said that the charging efficiency at the upstream portion of the charging member 23 is higher than that at the downstream portion of the charging member 23. Accordingly, it is considered that the occurrence of the springing phenomenon at the upstream conductive bristle members 25T and 25U having a high charging efficiency is a second or main cause of the charging nonuniformity.

In view of the above results of examination, it was tried to set the amount of engagement of the upstream portion of the conductive bristle members 25 with the subject surface 1*a* greater than that of the downstream portion thereof, so as to prevent the deformation of all the conductive bristle members 25 as enhancing the adhesion of all the conductive bristle members 25 to the subject surface 1*a* and also prevent the springing phenomenon at the upstream portion. This trial showed that the subject surface 1*a* can be uniformly charged.

Preferred Embodiment of the Invention

Figure 2:
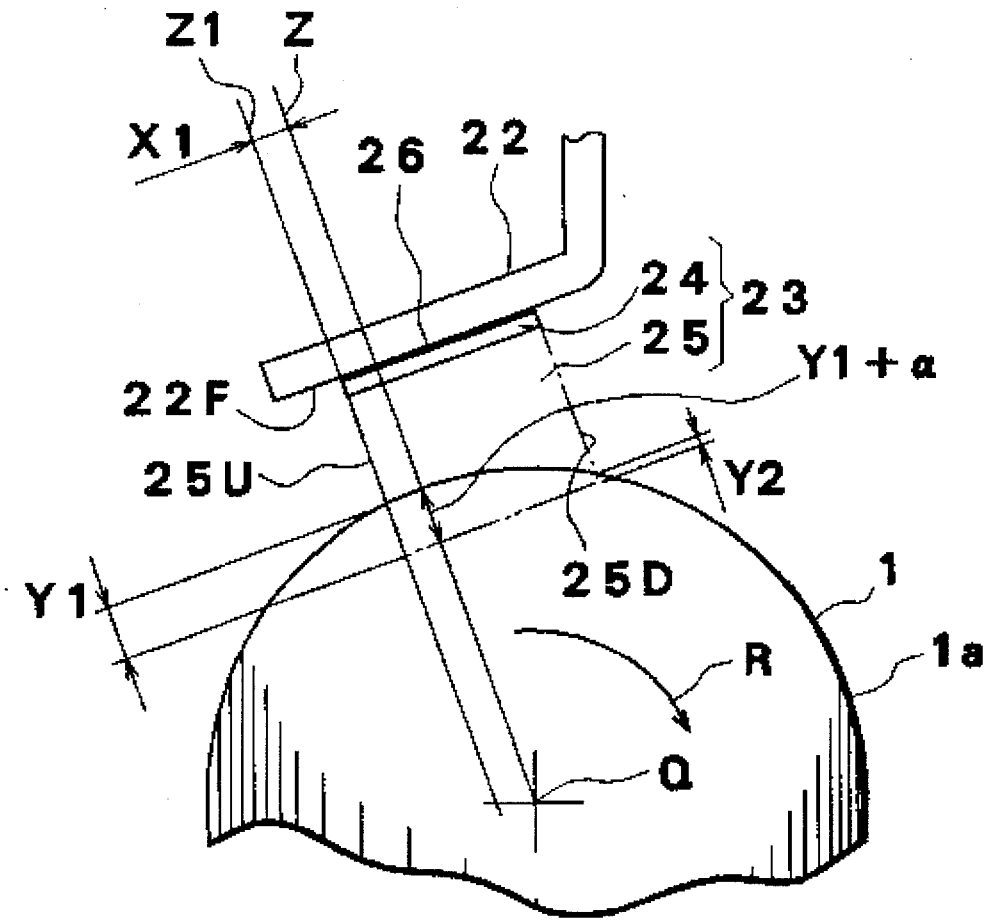
FIG. 2 is a fragmentary elevational view illustrating a position and an engagement amount of a charging member to a subject surface.

A preferred embodiment of the present invention will now be described with reference to FIGS. 1 and 2. The basic structure of a printing section 10 except a contact charging device is the same as that shown in FIG. 4, so the common components are denoted by the same reference numerals and the explanation thereof will be simplified or omitted herein. As shown in FIGS. 1 and 2, the contact charging device includes a charging member 23 having a brush structure formed by closely setting a plurality of conductive bristle members 25 into a conductive base member 24. The charging member 23 is located relative to a subject surface 1*a* so that the amount of engagement (Y) of the charging member 23 with the subject surface 1*a* is large on the upstream side of a surface moving direction of the subject surface 1*a* and small on the downstream side of the surface moving direction, in order to uniformly charge the subject surface 1*a* to a given potential Vc. In other words, the charging member 23 is supported so that the projecting ends of the bristle members 25 are in contact with the subject surface 1*a* of the image supporting body 1 (photosensitive drum) and the center portions of the bristle members 25 shift at a prescribed amount towards a rotational direction R of the body 1 in parallel to the normal line Z passing through the rotational center of the body 1, as shown in FIG. 1.

In FIG. 1, the conductive base member 24 constituting the charging member 23 is formed from styrene-butadiene rubber (SBR), carbon, and a thickener. The ratio of SBR and carbon is set to 6:4, and the conductive base member 24 is formed as a sheet having a resistivity of 9 Ω·cm.

Each of the conductive bristle members 25 is formed of REC-M1 (conductive rayon) having a resistance of $10^5$ Ω and a fineness of 6 denier (600 D/100 F). The conductive bristle members 25 are uniformly set at a density of $10^5$/inch$^2$ in the conductive base member 24.

The charging member 23 is fixed through a double-sided adhesive tape 26 to a smooth surface 22F of a supporting member 22. The supporting member 22 is fixed to a body case (not shown) in such a position as shown in FIG. 1 relative to the subject surface 1*a*. As shown by a dots-dash line in FIG. 1, the mounted position of the charging member 23 is set so that the amount of engagement of the conductive bristle members 25 with the subject surface 1*a*, i.e., the outer circumferential surface of an image supporting body 1 is large on the upstream side of the surface moving direction (i.e., a direction R of rotation of the image supporting body 1) and small on the downstream side of the surface moving direction. The amount of engagement is defined as an amount of thrust of the conductive bristle members 25 in their straight condition from the subject surface 1*a* into the image supporting body 1 in a direction parallel to a normal line Z on the assumption that the image supporting body 1 is a non-resisting body. In FIG. 2, the amount of engagement of the conductive bristle members 25U on the most upstream side is represented by Y1, and the amount of engagement of the conductive bristle members 25D on the most downstream side is represented by Y2. Further, the amount of engagement of the conductive bristle members on the normal line Z is represented by Y1+α.

In this preferred embodiment, the conductive bristle members 25U on the most upstream side is located at a position lying on a line Z1 shifted by X1 in parallel to the normal line Z. The reason of such setting is to allow the conductive bristle members 25D on the most downstream side to contact with the subject surface 1*a* in relation to the size of the charging member 23. In other words, the arrangement of the charging member 23 is designed so as to increase the contactable conductive bristle members 25D and facilitate the enlargement in size of the charging member 23. In this preferred embodiment, Y1 is set to 1.00 m; X1 is set to 0.99–1.00 mm; and Y2 is set to 0.07 mm so as to make the conductive bristle members 25D contact with an arc of the subject surface 1*a* of the image supporting body 1.

In operation, when the image supporting body 1 is rotated in the direction R at a constant speed and a high-voltage power unit is started to apply a high voltage to the supporting member 22, all the conductive bristle members 25 of the charging member 23 follow the subject surface 1*a*. That is, all the conductive bristle members 25 are bent by different lengths corresponding to the different amounts of engagement to come into sliding contact with the subject surface 1*a*. Since the amount of engagement of the conductive bristle members 25U on the most upstream side is set large, the sliding contact of the conductive bristle members 25U can be improved. Accordingly, both the deformation of each conductive bristle member 25 and the springing phenomenon of the conductive bristle members 25U on the most upstream side can be simultaneously prevented. Furthermore, since the range of the sliding contact of the most upstream conductive bristle members 25U having a high charging efficiency is long, the subject surface 1*a* can be charged uniformly and smoothly.

The present invention has been described with respect to a specific embodiment. However, other embodiments based on the principles of the present invention should be obvious to those of ordinary skill in the art. Such embodiments are intended to be covered by the claims.

What is claimed is:

1. A contact charging device for uniformly charging an outer surface of a rotatable subject body to a given potential, said contact charging device comprising:

a charging member having a brush structure formed by closely setting a plurality of conductive bristle members into a conductive base member, said bristle members including most upstream bristle members which are most upstream in relation to a rotative direction of said outer surface, said charging member being positioned so that an amount of engagement of said conductive bristle members with said outer surface is larger on an upstream side of said rotative direction of said outer surface and smaller on a downstream side of said rotative direction of said outer surface, and so that said most upstream bristle members are maintained in constant contact with said upstream side of said outer surface, thereby to prevent springing of the most upstream bristle members away from the outer surface and to avoid intermittent contact of the most upstream bristles with the outer surface; and means for applying a voltage to said charging member.

2. A contact charging device as recited in claim 1, wherein said subject body comprises a drum-shaped member rotatably supported.

3. A contact charging device as recited in claim 2, wherein said charging member is located at a position where a direction of a normal line of said subject body accords with a direction of setting of said conductive bristle members and where a center line of said charging member is offset from said normal line of said subject body to said downstream side of said rotative direction.

4. A contact charging device as recited in claim 1, further comprising a supporting member for supporting said charging member so that the amount of engagement of said conductive bristle members with said outer surface is large on said upstream side of said rotative direction and small on said downstream side of said rotative direction.

5. A contact charging device as recited in claim 1, further comprising a supporting member for supporting said charging member, said supporting member being supported so that the amount of engagement of said conductive bristle members with said outer surface is large on said upstream side of said rotative direction and small on said downstream side of said rotative direction.

6. A contact charging device as recited in claim 1, wherein said conductive bristle members are uniformly set in said conductive base member.

7. A contact charging device as recited in claim 1, wherein said conductive bristle members are formed of conductive rayon.

8. A contact charging device as recited in claim 1, wherein said conductive base member is formed from styrene-butadiene rubber, carbon, and a thickener.

9. A contact charging device for uniformly charging an outer surface of a rotatable subject body to a given potential, said contact charging device comprising:

a charging member having a brush structure formed by closely setting a plurality of conductive bristle members into a conductive base member, said bristle members including most upstream bristle members which are most upstream in relation to a rotative direction of said outer surface, said;

means for applying a voltage to said charging member; and means for positioning said charging member so that said most upstream bristle members are maintained in constant contact with said upstream side of said outer surface, thereby to prevent springing of the most stream bristle members away from the outer surface and to avoid intermittent contact of the most upstream bristles with the subject surface, and so that an amount of engagement of said conductive bristle members with said outer surface is larger on an upstream side of said rotative direction of said subject body and smaller on a downstream side of said rotative direction.

10. A contact charging device as recited in claim 9, wherein said subject body comprises a drum-shaped member rotatably supported.

11. A contact charging device as recited in claim 10, wherein said charging member is located at a position where a direction of a normal line of said subject body accords with a direction of setting of said conductive bristle members and where a center line of said charging member is offset from said normal line of said subject body to said downstream side of said rotative direction.

12. A contact charging device as recited in claim 10, wherein said means for positioning said charging member comprises a supporting member for supporting said charging member and locating said charging member at a position where a direction of a normal line of said subject body accords with a direction of setting of said conductive bristle members and where a center line of said charging member is offset from said normal line of said subject body to said downstream side of said rotative direction.

13. An apparatus for forming an image comprising:

a rotatable photosensitive drum having a rotational center and an outer surface to be charged;

a contact charging device for charging the outer surface of the rotatable photosensitive drum to a given potential, the contact charging device including, a charging member having a conductive base member and a plurality of conductive bristle members closely projecting from the conductive base member, said bristle members including most upstream bristle members in relation to a rotative direction of said outer surface, and means for supporting the charging member so that an amount of engagement of the bristle members with the outer surface is larger on an upstream side of the outer surface and smaller on the downstream side of the outer surface, and so that projecting ends of the bristle members are in constant contact with the outer surface of the rotatable photosensitive drum and a center portion of the bristle members is offset at a prescribed amount from an ideal line passing through the rotational center of the photosensitive drum towards a rotational direction of the photosensitive drum in parallel to the ideal line, thereby to prevent springing of the most upstream bristle members away from the outer surface and to avoid intermittent contact of the most upstream bristles with the outer surface,;

means for applying a voltage to the charging member; and means for forming an image on the surface of the photosensitive drum.

* * * * *